US011035140B2

(12) United States Patent
Aujaghian

(10) Patent No.: US 11,035,140 B2
(45) Date of Patent: Jun. 15, 2021

(54) SEISMIC ISOLATOR AND DAMPING DEVICE

(71) Applicant: Damir Aujaghian, Newport Beach, CA (US)

(72) Inventor: Damir Aujaghian, Newport Beach, CA (US)

( * ) Notice: Subject to any disclaimer, the term of this patent is extended or adjusted under 35 U.S.C. 154(b) by 48 days.

(21) Appl. No.: 16/380,304

(22) Filed: Apr. 10, 2019

(65) Prior Publication Data

US 2019/0316376 A1 Oct. 17, 2019

Related U.S. Application Data

(60) Provisional application No. 62/658,104, filed on Apr. 16, 2018.

(51) Int. Cl.
*E04H 9/02* (2006.01)
*E04B 1/98* (2006.01)

(52) U.S. Cl.
CPC ..... *E04H 9/021* (2013.01); *E04B 1/98* (2013.01); *E04H 9/0235* (2020.05)

(58) Field of Classification Search
CPC ..... E02D 27/34; E04B 1/985; E04H 9/021; E04H 9/022; E04H 9/02; E04H 9/0215
USPC ..... 52/167.1, 167.2, 167.4–167.7, 167.8, 52/167.9
See application file for complete search history.

(56) References Cited

U.S. PATENT DOCUMENTS 2,660,387 A 11/1953 Roy
3,638,377 A 2/1972 Caspe
4,074,474 A 2/1978 Cristy
4,499,694 A 2/1985 Buckle et al.
(Continued)

FOREIGN PATENT DOCUMENTS

JP 5948457 7/2016
RU 1794143 A3 2/1993
(Continued)

OTHER PUBLICATIONS

PCT Search Report and Written Opinion for PCT/US2014/011512, dated May 15, 2014, in 22 pages.
(Continued)

*Primary Examiner* — William V Gilbert
(74) *Attorney, Agent, or Firm* — Kobbe Martens Olson & Bear, LLP

(57) ABSTRACT

A sliding seismic isolator includes a first plate attached to a building support, and at least one elongate element extending from the first plate. The seismic isolator also includes a second plate. The first and second plates are capable of moving relative to one another along a horizontal plane. The seismic isolator also includes a lower support member attached to the second plate, with a biasing arrangement positioned within the lower support member. The elongate element(s) extend from the first plate at least partially into the lower support member, and movement of the elongate element(s) is influenced or controlled by the biasing arrangement. The seismic isolator also includes a damping structure with closed ends spaced apart from the first plate and the base of the seismic isolator. The damping structure is configured to contain a substance, such as a liquid, gas, silicone, and/or a combination thereof, and to expand longitudinally when it is compressed.

20 Claims, 18 Drawing Sheets

(56) References Cited

U.S. PATENT DOCUMENTS

| | | | | |
|---|---|---|---|---|
| 4,527,365 | A | 7/1985 | Yoshizawa et al. | |
| 4,599,834 | A | 7/1986 | Fujimoto et al. | |
| 4,633,628 | A | 1/1987 | Mostaghel | |
| 4,713,917 | A | 12/1987 | Buckle et al. | |
| 4,887,788 | A * | 12/1989 | Fischer | E01D 19/041 248/562 |
| 4,978,581 | A | 12/1990 | Fukahori et al. | |
| 5,238,082 | A | 8/1993 | Stegman et al. | |
| 5,324,117 | A | 6/1994 | Matsushita et al. | |
| 5,456,047 | A | 10/1995 | Dorka | |
| 5,461,835 | A | 10/1995 | Tarics | |
| 5,490,356 | A | 2/1996 | Kemeny | |
| 5,597,240 | A | 1/1997 | Fyfe | |
| 5,682,712 | A | 11/1997 | Kemeny | |
| 5,761,856 | A | 6/1998 | Kishizono | |
| 5,765,322 | A | 6/1998 | Kubo et al. | |
| 5,797,228 | A | 8/1998 | Kemeny | |
| 5,848,660 | A | 12/1998 | McGreen | |
| 6,138,967 | A | 10/2000 | Okamoto | |
| 6,385,918 | B1 | 5/2002 | Robinson | |
| 7,565,774 | B2 | 7/2009 | Shizuku et al. | |
| 7,716,881 | B2 | 5/2010 | Tsai | |
| 7,743,563 | B2 | 6/2010 | Hilmy | |
| 8,844,205 | B2 | 9/2014 | Michael et al. | |
| 9,534,379 | B2 | 1/2017 | Aujaghian | |
| 10,030,404 | B2 | 7/2018 | Aujaghian | |
| 10,480,206 | B2 | 11/2019 | Aujaghian | |
| 2002/0166295 | A1 | 11/2002 | Shustov | |
| 2008/0098670 | A1 | 5/2008 | Hsu | |
| 2009/0313917 | A1 | 12/2009 | Takenoshita | |
| 2014/0223841 | A1 * | 8/2014 | Aujaghian | E04H 9/0215 52/167.8 |
| 2015/0000217 | A1 * | 1/2015 | Sarlis | E04H 9/021 52/167.2 |
| 2015/0101269 | A1 * | 4/2015 | Moreno | E04B 1/98 52/167.5 |
| 2019/0017284 | A1 | 1/2019 | Aujaghian | |

FOREIGN PATENT DOCUMENTS

| | | | |
|---|---|---|---|
| RU | 46517 | U1 | 7/2005 |
| RU | 101514 | U1 | 1/2011 |
| SU | 1733572 | A1 | 5/1992 |
| WO | WO 2014/110582 | | 7/2014 |
| WO | WO 2019/204090 | | 10/2019 |

OTHER PUBLICATIONS

International Search Report and Written Opinion in Application No. PCT/US2019/026719, dated Jul. 23, 2019, in 12 pages.

* cited by examiner

SEISMIC ISOLATOR AND DAMPING DEVICE

INCORPORATION BY REFERENCE TO RELATED APPLICATIONS

Any and all applications identified in a priority claim in the Application Data Sheet, or any correction thereto, are hereby incorporated by reference herein and made a part of the present disclosure.

BACKGROUND

Field

The present application is directed generally toward seismic isolators, and specifically toward seismic isolators for use in conjunction with buildings to inhibit damage to the buildings in the event of an earthquake.

Description of Related Art

Seismic isolators are commonly used in areas of the world where the likelihood of an earthquake is high. Seismic isolators typically comprise a structure or structures that are located beneath a building, underneath a building support, and/or in or around the foundation of the building.

Seismic isolators are designed to minimize the amount of load and force that is directly applied to the building during the event of an earthquake, and to prevent damage to the building. Many seismic isolators incorporate a dual plate design, wherein a first plate is attached to the bottom of a building support, and a second plate is attached to the building's foundation. Between the plates are layers of rubber, for example, which allow side-to-side, swaying movement of the plates relative to one another. Other types of seismic isolators for example incorporate a roller or rollers built beneath the building, which facilitate movement of the building during an earthquake. The rollers are arranged in a pendulum-like manner, such that as the building moves over the rollers, the building shifts vertically at first until it eventually settles back in place.

SUMMARY

An aspect of at least one of the embodiments disclosed herein includes the realization that current seismic isolators fail to provide a smooth, horizontal movement of the building relative to the ground during an earthquake. As described above, current isolators permit some horizontal movement, but the movement is accompanied by substantial vertical shifting or jarring of the building, and/or a swaying effect that causes the building to tilt from side to side as it moves horizontally. Such movement can cause unwanted damage or stress on the building. Additionally, the rubber in current isolators can lose its strain capacity over time. It would be advantageous to have a simplified seismic isolator that can more efficiently permit smooth, horizontal movement of a building in any compass direction during an earthquake, avoiding at least one or more of the problems of current isolators described above.

Thus, in accordance with at least one embodiment disclosed herein, a sliding seismic isolator can comprise a first plate configured to be attached to a building support, with an elongated element (or elements) extending from the center of (central portion of, or other suitable locations of) the first plate. The sliding seismic isolator can further comprise a second plate and a low-friction layer positioned between the first and second plates configured to allow the first and second plates to move freely relative to one another along a horizontal plane. The sliding seismic isolator can further comprise a lower support member attached to the second plate, with at least one spring member or perforated elastomeric element positioned within the lower support member; the elongated element or elements extending from the first plate at least partially into the lower support member. The sliding seismic isolator can reduce seismic forces at ground level before they can affect the relevant structure.

In accordance with at least one embodiment disclosed herein, a sliding seismic isolator can comprise a first plate configured to be attached to a building support, with at least one elongate element extending from the first plate. The sliding seismic isolator can further comprise a second plate and a low-friction layer positioned between the first and second plates and configured to allow the first and second plates to move relative one another along a horizontal plane. The sliding seismic isolator can further comprise a lower support member attached to the second plate, with a biasing element positioned within the lower support member. The sliding seismic isolator can further comprise at least one damping structure comprising a first closed end spaced from the first plate and a second closed end spaced from a base of the seismic isolator, the damping structure containing a deformable substance and being configured to expand longitudinally when compressed.

In accordance with at least one embodiment disclosed herein, a system can comprise a plurality of isolators configured to be attached to a building support, wherein at least one of the isolators is configured to provide a lower re-centering force than another one of the isolators.

In accordance with at least one embodiment disclosed herein, a method of supporting a structure for seismic isolation and re-centering can comprise supporting the structure with one or more of a first type of seismic isolator and supporting the structure with one or more of a second type of seismic isolator having a re-centering force that is lower than the first type of seismic isolator. The first type of seismic isolator can be configured to provide more shock absorption than the second type of seismic isolator. The method can further comprise re-centering one or more of the first type of seismic isolator using one or more of the second type of seismic isolator.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION

For convenience, the embodiments disclosed herein are described in the context of a sliding seismic isolator device for use with commercial or residential buildings, or bridges. However, the embodiments can also be used with other types of buildings or structures where it may be desired to minimize, inhibit, and/or prevent damage to the structure during the event of an earthquake.

Various features associated with different embodiments will be described below. All of the features of each embodiment, individually or together, can be combined with features of other embodiments, which combinations form part of this disclosure. Further, no feature is critical or essential to any embodiment.

Figure 1:
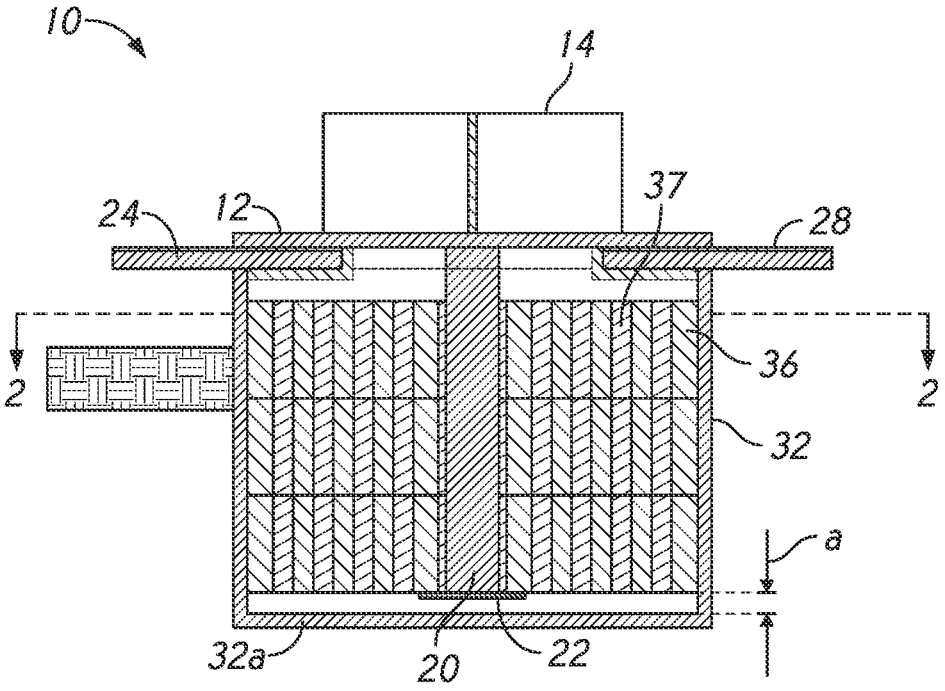
FIG. 1 is a cross-sectional schematic illustration of an embodiment of a sliding seismic isolator attached to a building support.

With reference to FIG. 1, a seismic isolator 10 can comprise a device configured to inhibit damage to a building during the event of an earthquake. The seismic isolator 10 can comprise two or more components that are configured to move relative to one another during the event of an earthquake. For example, the seismic isolator 10 can comprise two or more components that are configured to slide relative to one another generally or substantially along a geometrical plane during an earthquake. The seismic isolator 10 can comprise at least one component that is attached to a building support, and at least another component attached to the building's foundation and/or in or above the ground. In some embodiments, the seismic isolator 10 is accessible. In some embodiments, one or more cameras can be used to monitor the seismic isolator 10. For example, cameras can be used to inspect the seismic isolator 10 and/or portions of the building and/or foundation near the seismic isolator (e.g., to investigate after an earthquake).

Figure 3:
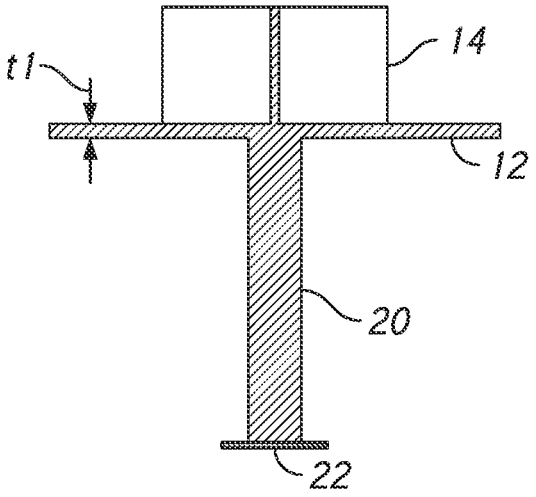
FIG. 3 is a front elevational view of the building support and a portion of the seismic isolator of FIG. 1.
Figure 4:
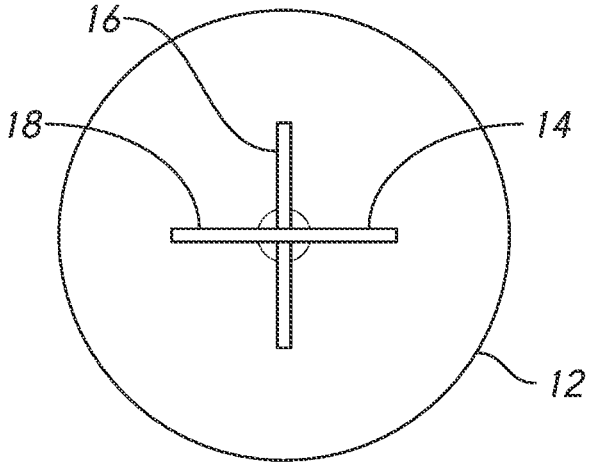
FIG. 4 is a top plan view of the building support and portion shown in FIG. 3.

With reference to FIGS. 1, 3, and 4, for example, a seismic isolator 10 can comprise a first plate 12. The first plate 12 can comprise a circular or an annular shaped plate, although other shapes are also possible (e.g., square.) The first plate 12 can be formed of metal, for example stainless steel, although other materials or combinations of materials are also possible. For example, in some embodiments the first plate 12 can be comprised primarily of metal, but with at least one layer of a plastic or polymer material, such as polytetrafluoroethylene (PTFE), which is sold under the trademark TEFLON®, or other similar materials. The first plate 12 can also have a thickness. The first plate 12 can also have a thickness. In some embodiments the thickness can generally be constant throughout the first plate 12, although varying thicknesses can also be used. In some embodiments the first plate 12 can have a thickness "t1" of approximately ½ inch, although other values are also possible. The thickness "t1" can vary, based on the expected loads.

As seen in FIGS. 3 and 4, the first plate 12 can be attached to or integrally formed with the bottom of a building support 14. The building support 14 can comprise, for example, a cross-shaped support having first and second support components 16, 18, although other types of building supports 14 can also be utilized in conjunction with the first plate 12. The building support 14 can be made of wood, steel, concrete, or other material. The first plate 12 can be attached to the building support 14, for example, by welding the first plate 12 to the bottom of the building support 14, or by using fasteners such as bolts, rivets, or screws, or other known methods. The first plate 12 can be rigidly attached to the building support 14, such that substantially no relative movement occurs between the first plate 12 and the building support 14.

With continued reference to FIGS. 1, 3, and 4, at least one elongate element 20 can extend from the first plate 12. The elongate element 20 can be formed integrally with the first plate 12, or can be attached separately. For example, the elongate element 20 can be bolted or welded to the first plate 12. The elongate element 20 can comprise a cylindrical metal rod, although other shapes are also possible. In some embodiments the elongate element 20 can have a circular cross-section. In some embodiments the elongate element 20 can be a solid steel (or other suitable material) bar. The elongate element 20 can extend from a geometric center of the first plate 12. In some embodiments the elongate element 20 can extend generally perpendicularly relative to a surface of the first plate 12. In some embodiments, multiple elongate elements 20 can extend from the first plate 12. For example, in some embodiments four elongate elements 20 can extend generally from a geometric center of the first plate 12. In some embodiments the multiple elongate elements 20 can flex and/or bend so as to absorb some of the energy from seismic forces during an earthquake. The elongate element 20 can also optionally include a cap 22. The cap 22 can be integrally formed with the remainder of the elongate element 20. The cap 22 can be comprised of the same material as that of the remainder of the elongate element 20, although other materials are also possible. The cap 22 can form a lowermost portion of the elongate element 20.

With reference to FIGS. 1, 2, 5, and 6, the seismic isolator 10 can comprise a second plate 24. The second plate 24 can comprise a circular or an annular shaped plate, although other shapes are also possible (e.g., square.) The second plate 24 can be formed of metal, for example stainless steel, although other materials or combinations of materials are also possible. For example, in some embodiments the second plate 24 can be comprised primarily of metal, with a PTFE (or other similar material) adhered layer. The second plate 24 can also have a thickness. In some embodiments the thickness can generally be constant throughout the second plate 24, although varying thicknesses can also be used. In some embodiments, the second plate 24 can have a thickness "t2" of approximately ½ inch, although other values are also possible. The thickness "t2" can vary, based on the expected loads.

Figure 2:
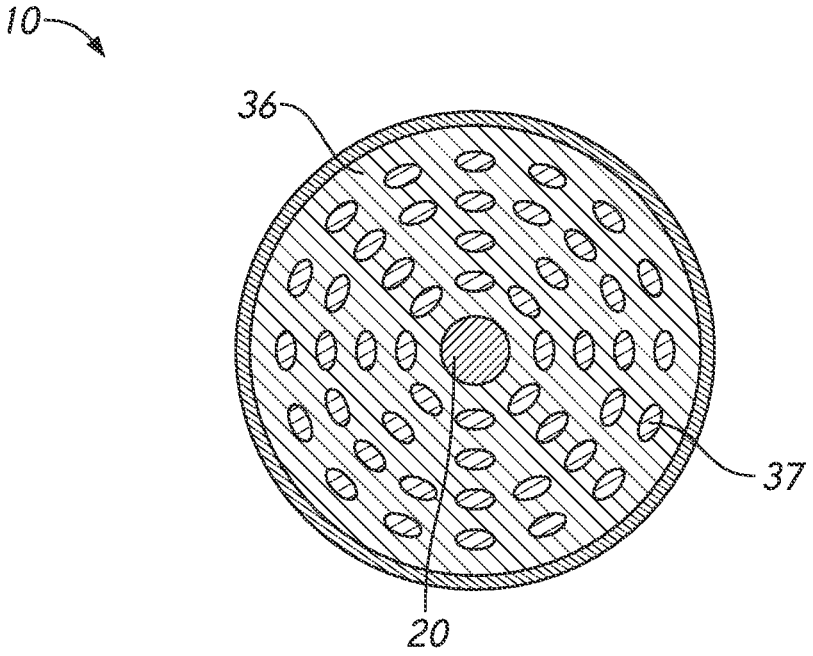
FIG. 2 is a cross-sectional view of the seismic isolator of FIG. 1, taken along line 2-2 in FIG. 1.
Figure 5:
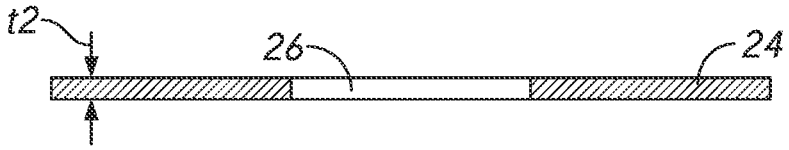
FIG. 5 is a cross-sectional view of a portion of the seismic isolator of FIG. 1.
Figure 6:
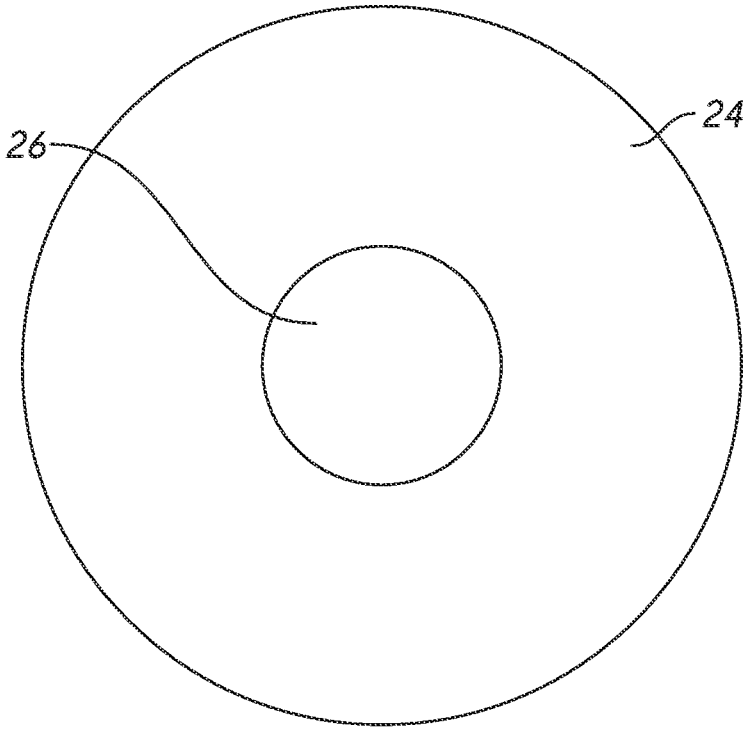
FIG. 6 is a top plan view of the portion shown in FIG. 5.

With reference to FIGS. 5 and 6, the second plate 24 can include an opening 26. The opening 26 can be formed at a geometric center of the second plate 24. With reference to FIGS. 1 and 2, the opening 26 can be configured to receive the elongate element 20. The opening 26 can be configured to accommodate movement of the elongate element 20 and first plate 12 relative to the second plate 24.

Figure 7:
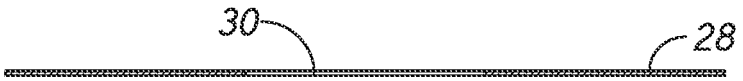
FIG. 7 is a cross-sectional view of a portion of the seismic isolator of FIG. 1.
Figure 8:
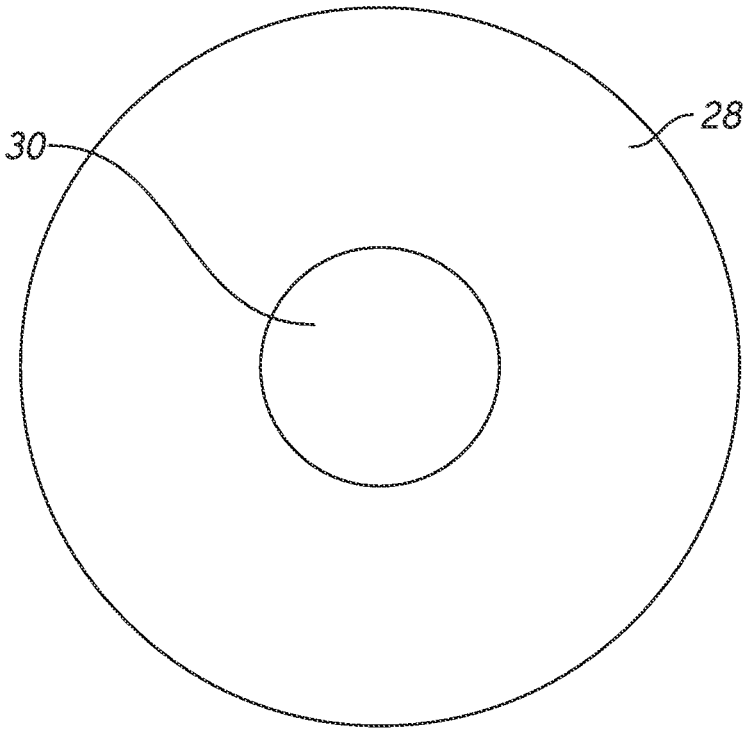
FIG. 8 is a top plan view of the portion shown in FIG. 7.

For example, and with reference to FIGS. 1, 7, and 8, the seismic isolator 10 can comprise a low-friction layer 28. The low-friction layer 28 can comprise, for example, PTFE or other similar materials. The low-friction layer 28 can be in the form of a thin, annular-shaped layer having an opening 30 at its geometric center. Other shapes and configurations for the low-friction layer 28 are also possible. Additionally, while one low-friction layer 28 is illustrated, in some embodiments multiple low-friction layers 28 can be used. In alternative arrangements, the low-friction layer 28 can comprise a movement assisting layer, which could include movement assisting elements (e.g., bearings.)

With continued reference to FIGS. 1, 7 and 8, the low-friction layer 28 can have generally the same profile as that of the second plate 24. For example, the low-friction layer 28 can have the same outer diameter as that of the second plate 24, as well as the same diameter-sized opening in its geometric center as that of second plate 24. In some embodiments the low-friction layer 28 can be formed onto and/or attached to the first plate 12 or second plate 24. For example, the low-friction layer 28 can be glued to the first plate 12 or second plate 24. The low-friction layer 28 can be a layer, for example, that provides a varying frictional resistance between the first and second plates 12 and 24 (as opposed to the normal 100% generated between the two plates). Preferably, the low-friction layer 28 at least provides reduced frictional resistance compared to the material used for the first plate 12 and the second plate 24. For example, as illustrated in FIG. 1, in some embodiments the first plate 12, low-friction layer 28, and second plate 24 can form a sandwiched configuration. Both the first plate 12 and the second plate 24 can be in contact with the low-friction layer 28, with the low-friction layer 28 allowing relative movement of the first plate 12 relative to the second plate 24. The first plate 12 and second plate 24 can thus be independent components of the seismic isolator 10, free to move relative to one another along a generally horizontal plane. In some embodiments the first and second plates 12 and 24 can support at least a portion of the weight of the building.

Figure 9:
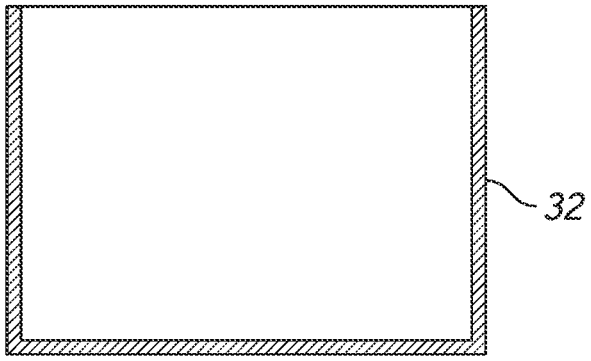
FIG. 9 is a cross-sectional view of a portion of the seismic isolator of FIG. 1.
Figure 10:
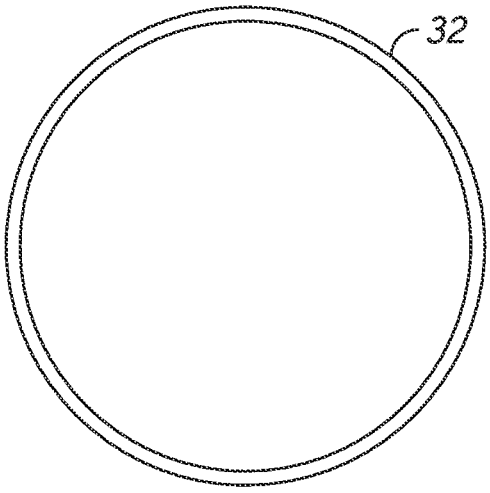
FIG. 10 is a top plan view of the portion shown in FIG. 9.

With reference to FIGS. 1, 9, and 10, the seismic isolator 10 can additionally comprise a lower support element 32. The lower support element 32 can be configured to stabilize the second plate 24 and hold it in place, thereby allowing only the first plate 12 to move relative to the second plate 24. In some embodiments the lower support element 32 can be attached directly to or be formed integrally with the second plate 24. The lower support element 32 can comprise an open cylindrical shell, as shown in FIGS. 9 and 10, although other shapes and configurations are also possible. The lower support element 32 can be buried in a foundation or otherwise attached to a foundation of the building, such that the lower support element generally moves with the foundation during the event of an earthquake. In some embodiments, the lower support element 32 can include a base plate **32*a*. In some embodiments, the base plate 32*a* can be a separate component from the lower support element 32. The base plate 32*a* can be attached to the lower support element 32** and/or the foundation of the building.

Figure 11:
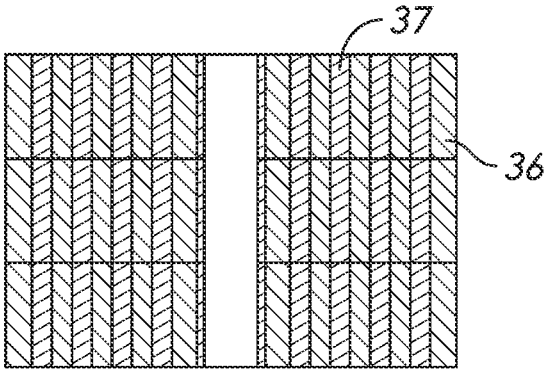
FIG. 11 is a cross-sectional view of a portion of the seismic isolator of FIG. 1.
Figure 12:
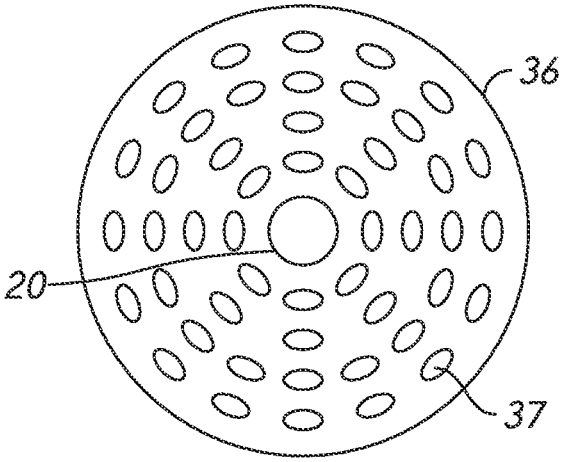
FIG. 12 is a top plan view of the portion shown in FIG. 11.
Figure 13:
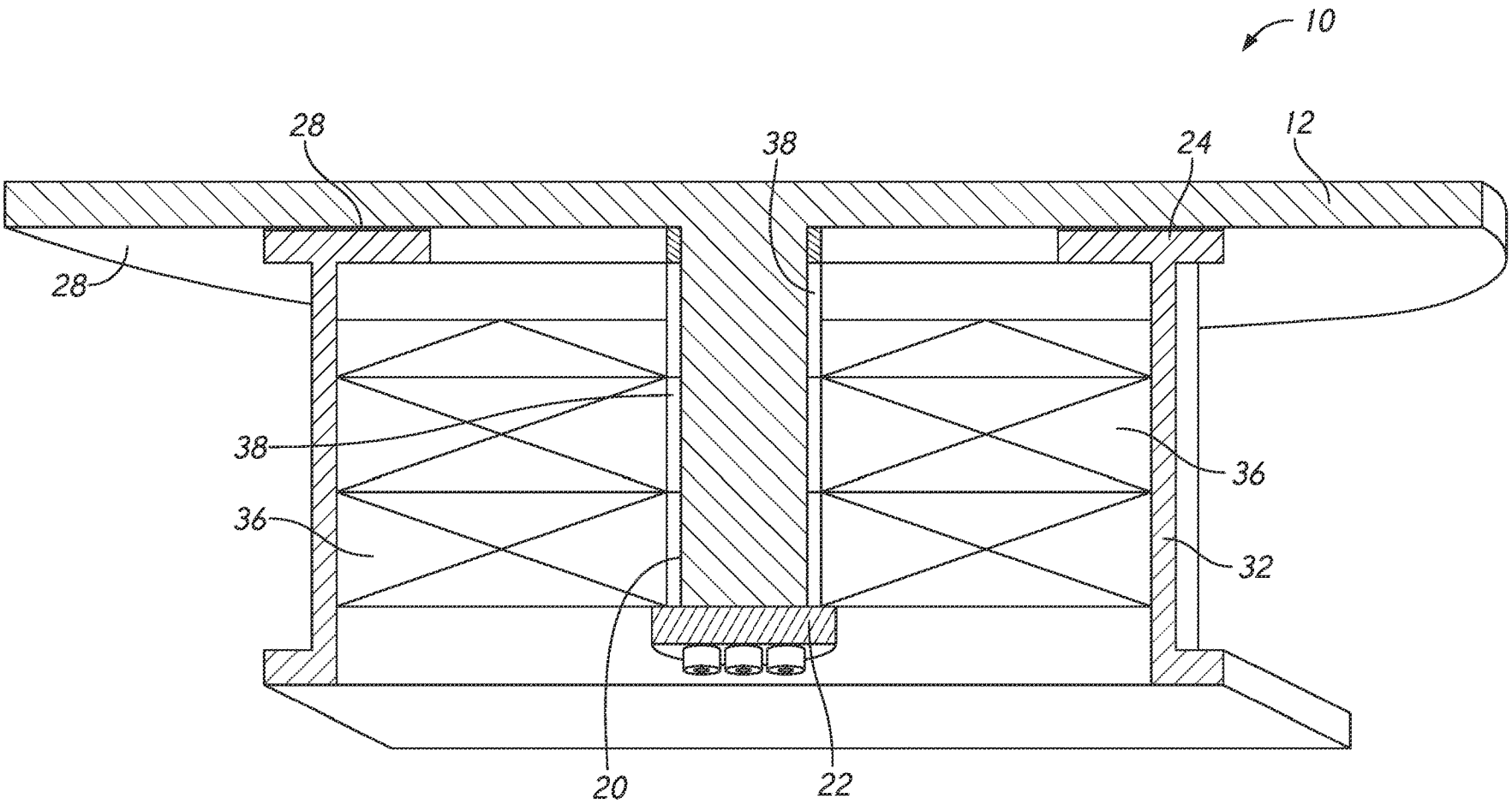
FIG. 13 is a cross-sectional view of a modification of the seismic isolator of FIGS. 1-12.

With reference to FIGS. 1, 2, 11, 12 and 13 the lower support element 32 can be configured to house at least one component that helps guide the elongate element 20 and return the elongate element 20 back toward or to an original resting position after the event of an earthquake. For example, as illustrated in FIGS. 1, 11 and 12, the seismic isolator 10 can comprise at least one biasing element 36, such as a spring component or engineered perforated rubber component. The biasing element 36 can be an elastomeric material or other spring component. The biasing element 36 can be a single component or multiple components (e.g., a stack of components, as illustrated). Preferably, the biasing element 36 includes voids or perforations 37, which can be filled with a material, such as a liquid or solid material (e.g., silicone). The biasing element 36 can comprise flat metal springs or engineered perforated rubber. The biasing element 36 can be housed within the lower support element 32. The number and configuration of the biasing element(s) 36 used can depend on the size of the building. FIG. 13 illustrates the biasing element 36 in schematic form, which can be or include rubber components, spring components, other biasing elements or any combination thereof.

With continued reference to FIGS. 1, 2, 11, and 12, the seismic isolator 10 can comprise an engineered elastomeric material. The biasing element 36 can comprise synthetic rubber, although other types of materials are also possible. A protective material, such as a liquid (e.g., oil), may be used to preserve the properties of the biasing element 36. The biasing element 36 can be used to fill in the remaining gaps or openings within the lower support element 32. The biasing element 36 can be used to help guide the elongate element 20 and return the elongate element 20 back toward or to an original resting position after the event of an earthquake.

The elongate element 20 can be vulcanized and/or adhered to the biasing element 36. This can create additional resistance to relative vertical movement between the elongate element 20 and the biasing element 36, for example, when wind forces or seismic forces are present. The elongate element 20 can be adhered to the biasing element 36 along any suitable portion of the elongate element 20. For example, the elongate element 20 can be adhered to the biasing element 36 along a portion or an entirety of the overlapping length of the biasing element 36 and the side edges of the elongate element 20.

The seismic isolator 10 can additionally comprise at least one retaining element 38 (FIG. 13). The retaining elements 38 can be configured to retain and/or hold the elongate element 20. The retaining elements 38 can comprise, for example, hardened elastomeric material and/or adhesive, such as glue. If desired, different possible retaining elements can be used. Various numbers of retaining elements are possible. During assembly of the seismic isolator 10, the elongate element 20 can be inserted for example down through the retaining elements.

Overall, the arrangement of the seismic isolator 10 can provide a support framework for allowing the elongate element 20 to shift horizontally during an earthquake in any direction within the horizontal plane permitted by the opening 26. This can be due at least in part to a gap "a" (see FIG. 1) that can exist between the bottom of the elongate element 20 (e.g., at the cap 22) and the bottom of the lower support element 32. This gap "a" can allow the elongate element 20 to remain decoupled from the lower support element 32, and thus allow the elongate element 20 to move within the opening 26 of second plate 24 during the event of an earthquake. The gap "a," and more specifically the fact that the elongate element 20 is decoupled from the lower support element 32, allows the first plate 12 and building support 14, which are attached to or integrally formed with the elongate element 20, to slide horizontally during an earthquake as well. The gap "a" can vary in size.

The arrangement of the seismic isolator 10 can also provide a framework for bringing the building support 14 back toward or to its original resting position. For example, one or more biasing elements, such as shock absorbers, in conjunction with a series of retaining elements 38 and/or biasing element 36 within the lower support element 32, can work together to ease the elongate element 20 back toward a central resting position within the lower support element 32, thus bringing the first plate 12 and building support member 14 back into a desired resting position.

During the event of an earthquake, ground seismic forces can be transmitted through the biasing element 36 to the elongate element 20 and finally to the building or structure itself. The elongate element 20 and biasing element 36 can facilitate damping of the seismic forces. Lateral rigidity of the sliding isolator 10 can be controlled by the biasing element 36, frictional forces, and/or the elongate element 20. In the event of wind forces and small earthquakes, frictional forces alone (e.g., between the plates 12 and 24) can sometimes be sufficient to control or limit the movement of the building and/or prevent movement of the building altogether. Delays and damping of the movement of the structure can be controlled by the biasing element 36 with silicone-filled perforations 37 or spring components and the opening 26. In some embodiments, seismic rotational forces (e.g., torsional, twisting of the ground caused by some earthquakes) can be controlled easily due to the nature of the design of the isolator 10 described above. For example, because of the opening 26, elongate element 20, and/or biasing element 36, most if not all of the seismic forces can be absorbed and reduced by the isolator 10, thereby inhibiting or preventing damage to the building.

In some embodiments, the cap 22 can inhibit or prevent upward vertical movement of the first plate 12 during the event of an earthquake. For example, the cap 22 can have a diameter larger than that of the retaining elements 38, and the cap 22 can be positioned beneath the retaining elements 38 (see FIG. 1), such that the cap 22 inhibits the elongate element 20 from moving up vertically.

While one seismic isolator 10 is described and illustrated in FIGS. 1-12, in some embodiments, a building or other structure can incorporate a system of seismic isolators 10. For example the seismic isolators 10 can be located at and installed at particular locations underneath a building or other structure.

In some embodiments the seismic isolators 10 can be installed prior to the construction of a building. In some embodiments at least a portion of the seismic isolators can be installed as retrofit isolators 10 to an already existing building. For example, the support element 32 can be attached to the top of an existing foundation.

FIG. 13 illustrates a modification of the seismic isolator 10 in which the first plate 12 and the second plate 24 are essentially reversed in structure. In other words, the first plate 12 is larger in diameter than the second plate 24. The configuration of FIG. 13 can be well-suited for certain applications, such as bridges, for example and without limitation. A larger and longer top plate or first plate 12 could be utilized to fit other types of structures, including bridges. With such an arrangement, the second plate 24 supports the first plate 12 in multiple positions of the first plate 12 relative to the second plate 24. The low-friction layer 28 can be positioned on or applied to the bottom surface of the first plate 12 or the top surface of the second plate 24, or both. In other respects, the isolator 10 of FIG. 13 can be the same as or similar to the isolator 10 of FIGS. 1-12 (however, as described above, the biasing element 36 can be of any suitable arrangement). In some embodiments, for example, the biasing element 36 can comprise layers of radially-oriented compression springs.

FIGS. 14-17 describe and illustrate an alternative design of the seismic isolator 10. The embodiment of FIGS. 14-17 is similar to what was previously described in FIGS. 1-13, but is described in the context of a seismic isolator 10 with multiple elongate elements 20. Features not specifically discussed can be configured in the same or a similar manner as those discussed with reference to other embodiments.

Figure 14:
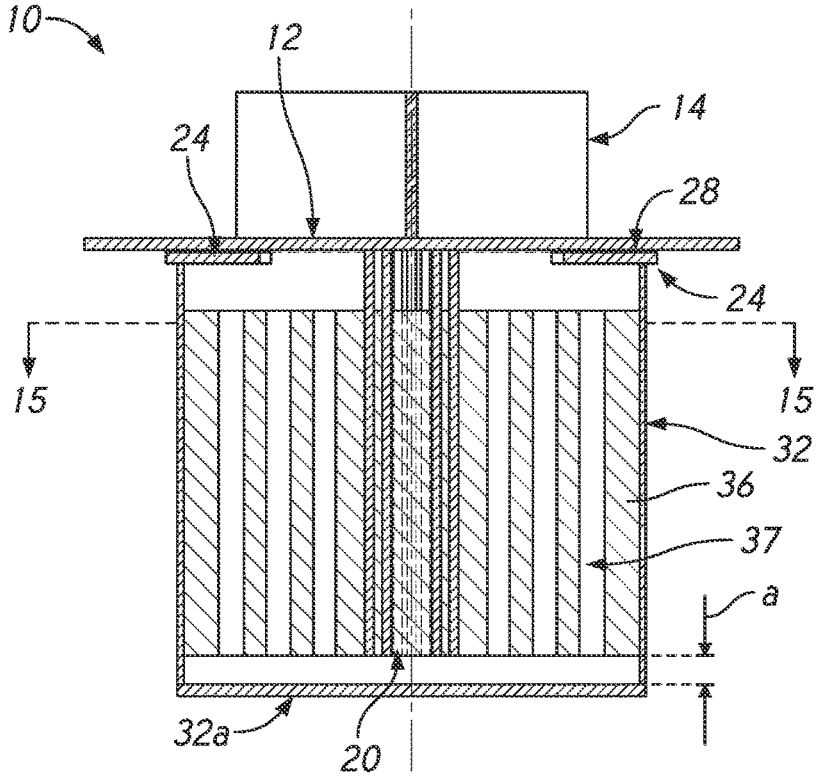
FIG. 14 is a cross-sectional schematic illustration of an embodiment of a sliding seismic isolator attached to a building support.
Figure 16:
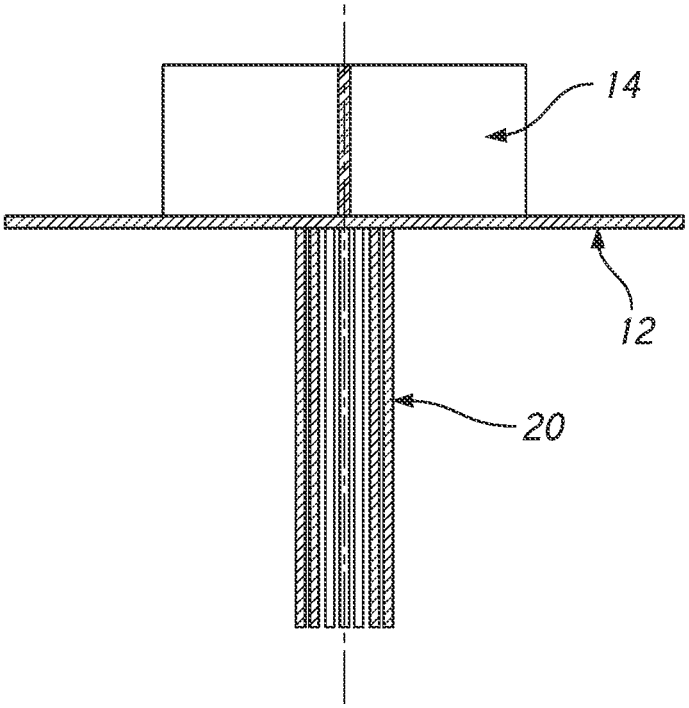
FIG. 16 is a front elevational view of the building support and a portion of the seismic isolator of FIG. 14.
Figure 17:
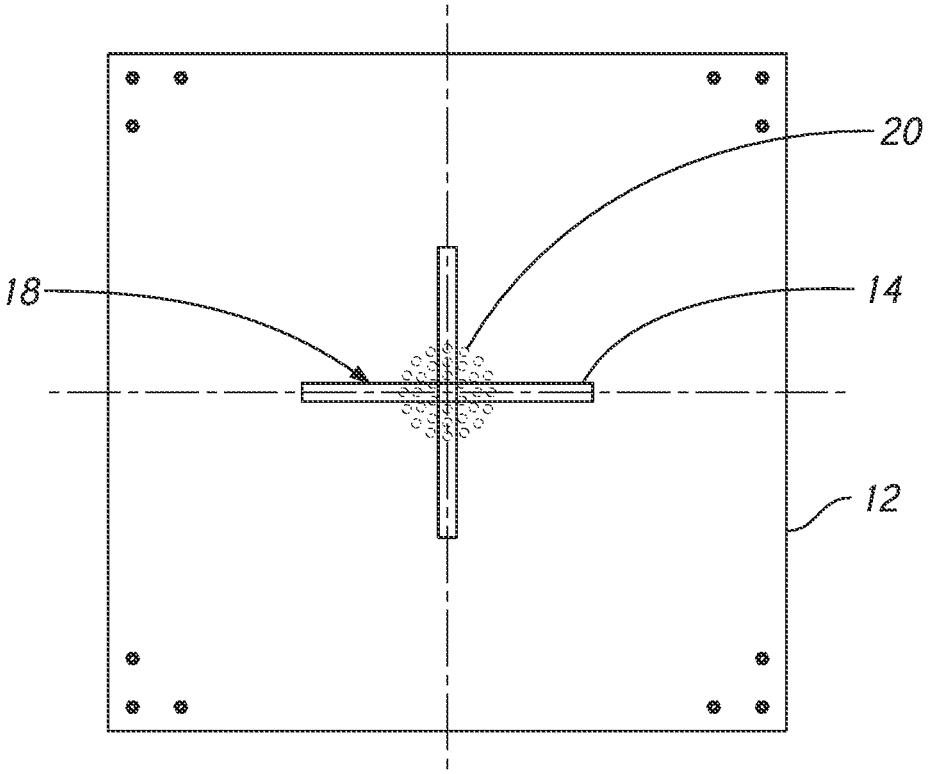
FIG. 17 is a top plan view of the building support and portion shown in FIG. 16.
Figure 18:
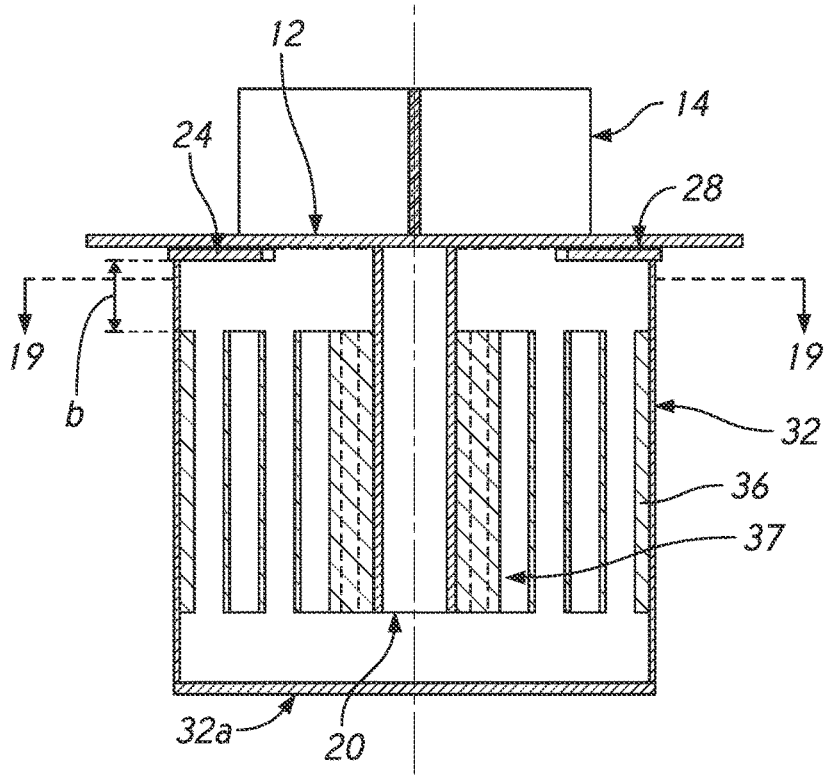
FIG. 18 is a cross-sectional schematic illustration of an embodiment of a sliding seismic isolator attached to a building support.
Figure 19:
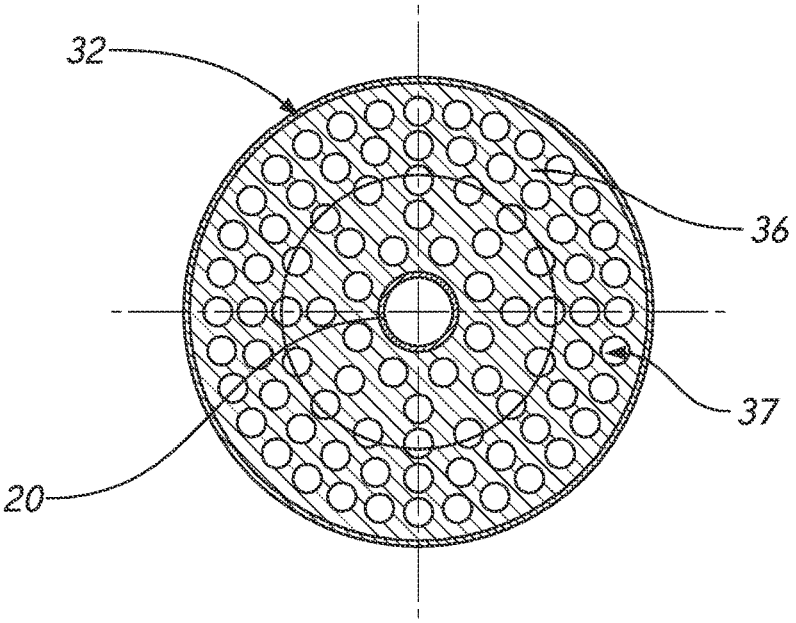
FIG. 19 is a cross-sectional view of the seismic isolator of FIG. 18, taken along line 19-19 in FIG. 18.
Figure 20:
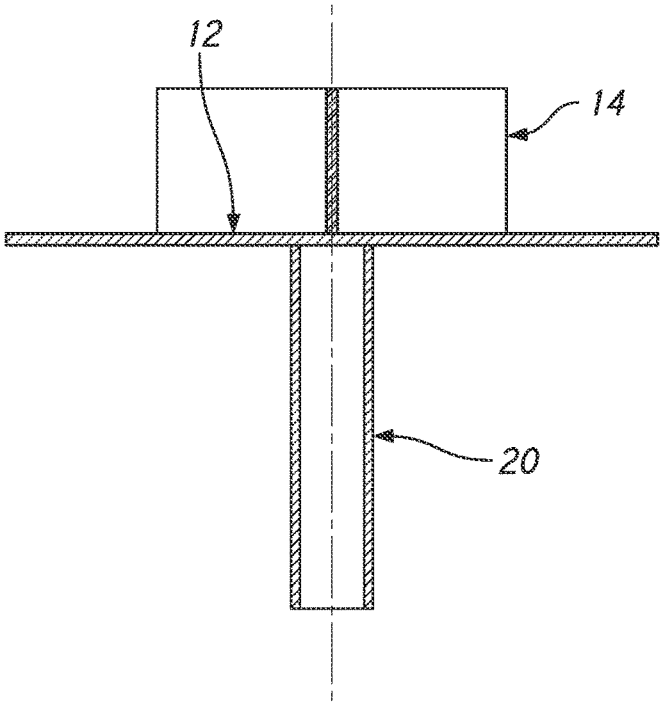
FIG. 20 is a front elevational view of the building support and a portion of the seismic isolator of FIG. 18.
Figure 21:
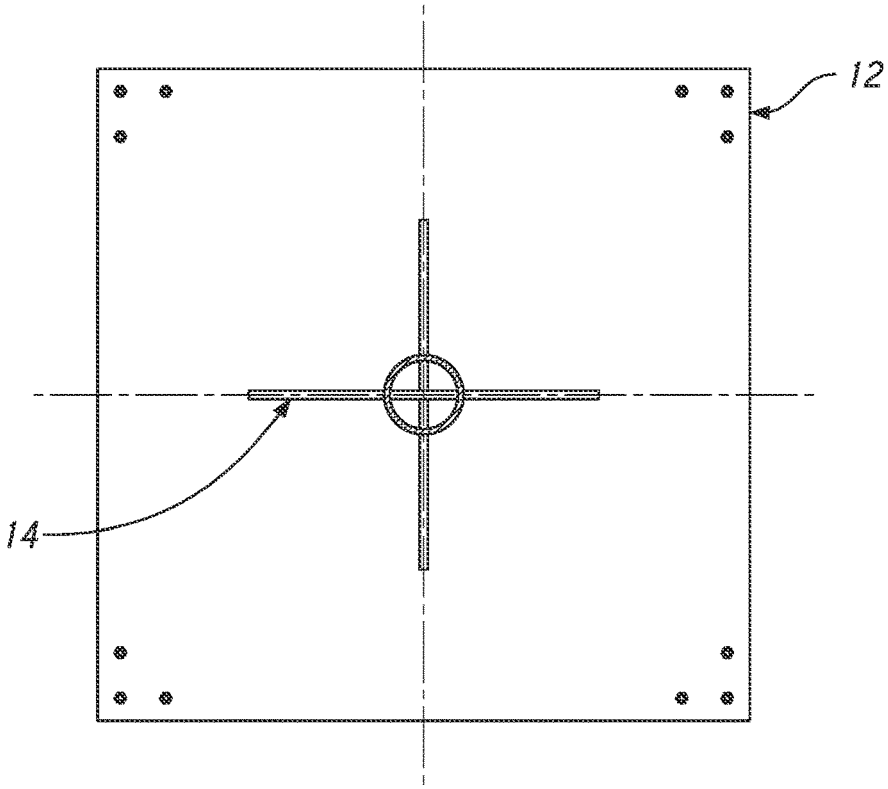
FIG. 21 is a top plan view of the building support and portion shown in FIG. 20.

With reference to FIGS. 14, 16, and 17, multiple elongate elements 20 can extend from the first plate 12. For example, in some embodiments 2-40 elongate elements 20 can extend generally from a geometric center of the first plate 12. In some configurations, the elongate elements 20 are contained within a cross-sectional area approximately equal to a cross-sectional area of the single elongate element 20 of the prior embodiments. The elongate elements can vary in size depending on relevant criteria, such as the expected loads.

For example, in some embodiments, the elongate elements 20 can be formed integrally with the first plate 12, or can be attached separately. For example, the elongate elements 20 can be bolted or welded to the first plate 12. The elongate elements 20 can comprise cylindrical metal rods, although other shapes are also possible. In some embodiments the elongate elements 20 can have circular cross-sections. In some embodiments the elongate elements 20 can be solid steel (or other suitable material) bars. The elongate elements 20 can extend generally from a geometric center of the first plate 12. In some embodiments the elongate elements 20 can extend generally perpendicularly relative to a surface of the first plate 12. In some embodiments the elongate elements 20 can flex and/or bend so as to absorb some of the energy from seismic forces during an earthquake. The elongate elements 20 can also optionally include a cap or caps, similar to the caps 22 of the prior embodiments.

Figure 15:
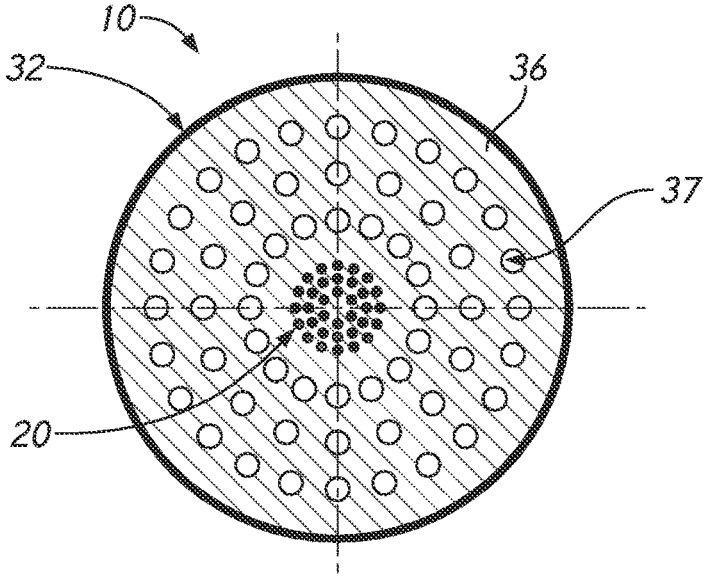
FIG. 15 is a cross-sectional view of the seismic isolator of FIG. 14, taken along line 15-15 in FIG. 14.

With reference to FIGS. 14 and 15, the opening 26 in the second plate 24 can be configured to receive the elongate elements 20. The opening 26 can be configured to accommodate movement of the elongate elements 20 and first plate 12 relative to the second plate 24.

With reference to FIGS. 14 and 15, the lower support element 32 can be configured to house at least one component that helps guide the elongate elements 20 and return the elongate elements 20 back toward or to an original resting position after the event of an earthquake. For example, the seismic isolator 10 can comprise at least one biasing element 36, such as a spring component or engineered perforated rubber component. The biasing element 36 can be a single component or multiple components (e.g., a stack of components, as illustrated). Preferably, the biasing element 36 includes voids or perforations 37, which can be filled with a material, such as a liquid or solid material (e.g., silicone). The biasing element 36 can comprise flat metal springs or engineered perforated rubber. The biasing element 36 can be housed within the lower support element 32. The number and configuration of the biasing element(s) 36 used can depend on the size of the building.

With continued reference to FIGS. 14 and 15, the seismic isolator 10 can comprise an engineered elastomeric material. The biasing element 36 can comprise synthetic rubber, although other types of materials are also possible. The biasing element 36 can be used to fill in the remaining gaps or openings within the lower support element 32. The biasing element 36 can be used to help guide the elongate elements 20 and return the elongate elements 20 back toward or to an original resting position after the event of an earthquake.

The elongate elements 20 can be vulcanized and/or adhered to the biasing element 36. This can create additional resistance to relative vertical movement between the elongate elements 20 and the biasing element 36, for example, when wind forces or seismic forces are present. The elongate elements 20 can be adhered to the biasing element 36 along any suitable portions of the elongate elements 20. For example, the elongate elements 20 can be adhered to the biasing element 36 along a portion or an entirety of the overlapping length of the biasing element 36 and the side edges of the elongate elements 20.

Overall, the arrangement of the seismic isolator 10 can provide a support framework for allowing the elongate elements 20 to shift horizontally during an earthquake in any direction within the horizontal plane permitted by the opening 26. This can be due at least in part to a gap "a" (see FIG. 14) that can exist between the bottoms of the elongate elements 20 (or cap(s)) and the bottom of the lower support element 32. This gap "a" can allow the elongate elements 20 to remain decoupled from the lower support element 32, and thus allow the elongate elements 20 to move within the opening 26 of second plate 24 during the event of an earthquake. The gap "a," and more specifically the fact that the elongate elements 20 are decoupled from the lower support element 32, allows the first plate 12 and building support 14, which are attached to or integrally formed with the elongate elements 20, to slide horizontally during an earthquake as well. The gap "a" can vary in size.

The arrangement of the seismic isolator 10 can also provide a framework for bringing the building support 14 back toward or to its original resting position. For example, one or more biasing elements, such as shock absorbers, in conjunction with a series of retaining elements 38 and/or the biasing element 36 within the lower support element 32, can work together to ease the elongate elements 20 back toward a central resting position within the lower support element 32, thus bringing the first plate 12 and building support member 14 back into a desired resting position.

During the event of an earthquake, ground seismic forces can be transmitted through the biasing element 36 to the elongate elements 20 and finally to the building or structure itself. The elongate elements 20 and biasing element 36 can facilitate damping of the seismic forces. Lateral rigidity of the sliding isolator 10 can be controlled by the spring components, frictional forces, and the elongate elements 20. In the event of wind forces and small earthquakes, frictional forces alone (e.g., between the plates 12 and 24) can sometimes be sufficient to control or limit the movement of the building and/or prevent movement of the building altogether. Delays and damping of the movement of the structure can be controlled by the biasing element 36 with silicone-filled perforations 37 or spring components and the opening 26. In some embodiments, seismic rotational forces (e.g., torsional, twisting of the ground caused by some earthquakes) can be controlled easily due to the nature of the design of the isolator 10 described above. For example, because of the opening 26, elongate elements 20, and/or biasing element 36, most if not all of the seismic forces can be absorbed and reduced by the isolator 10, thereby inhibiting or preventing damage to the building. The provision of multiple elongate elements 20 of a smaller diameter (or cross-sectional size) can allow for greater vibration damping relative to a single larger elongate element 20. Multiple elongate elements 20 of a smaller diameter (or cross-sectional size) can allow for more even distribution of forces than a single larger elongate element 20.

In some embodiments, the cap(s) (if present) can inhibit or prevent upward vertical movement of the first plate 12 during the event of an earthquake. For example, the cap(s) can have a diameter or define an overall diameter larger than that of the biasing element 36, and the cap(s) can be positioned beneath the biasing element 36 such that the cap(s) inhibits the elongate elements 20 from moving up vertically.

FIGS. 18-34 describe and illustrate alternative designs of the seismic isolator 10. The embodiments of FIGS. 18-34 are similar to what was previously described in FIGS. 1-17, but additionally or alternatively include certain features. For example, FIGS. 22-25 are described in the context of a seismic isolator 10 with a biasing element 36 disposed towards the base of the seismic isolator 10 and FIGS. 26-34 are described in the context of a seismic isolator 10 with a damping structure 40 to further facilitate damping of seismic forces. Features not specifically discussed can be configured in the same or a similar manner as those discussed with reference to other embodiments.

Figure 22:
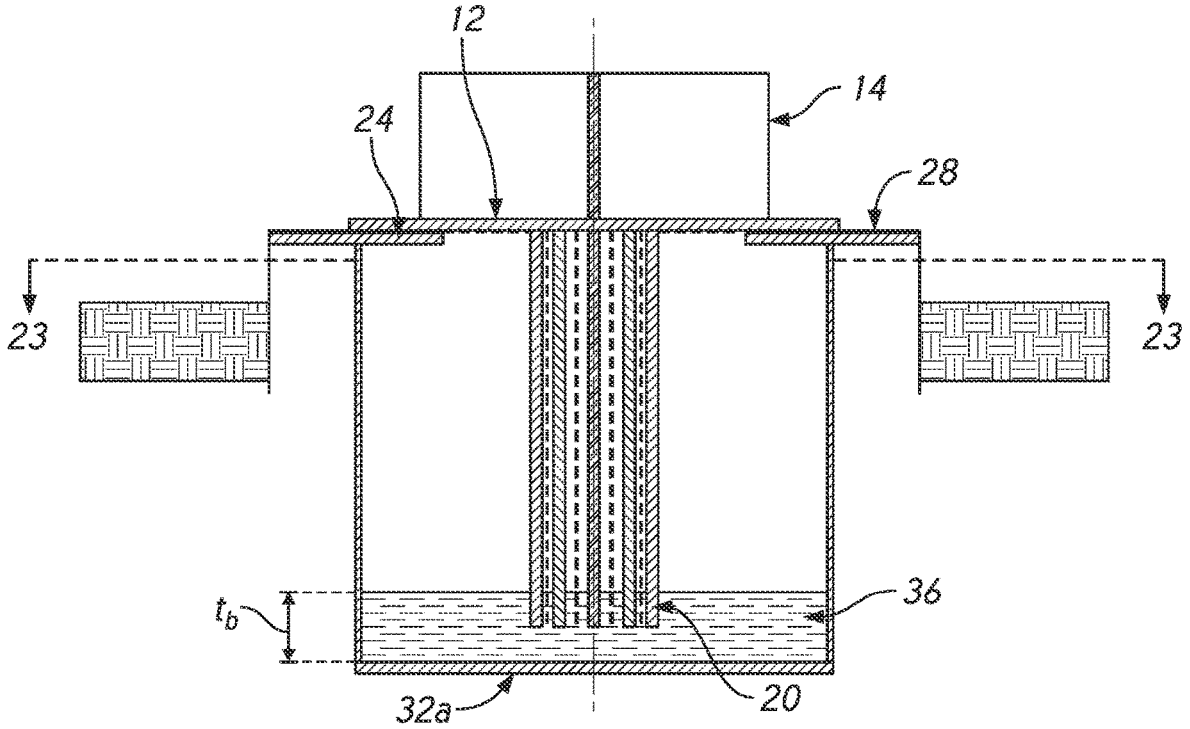
FIG. 22 is a cross-sectional schematic illustration of an embodiment of a sliding seismic isolator attached to a building support.
Figure 23:
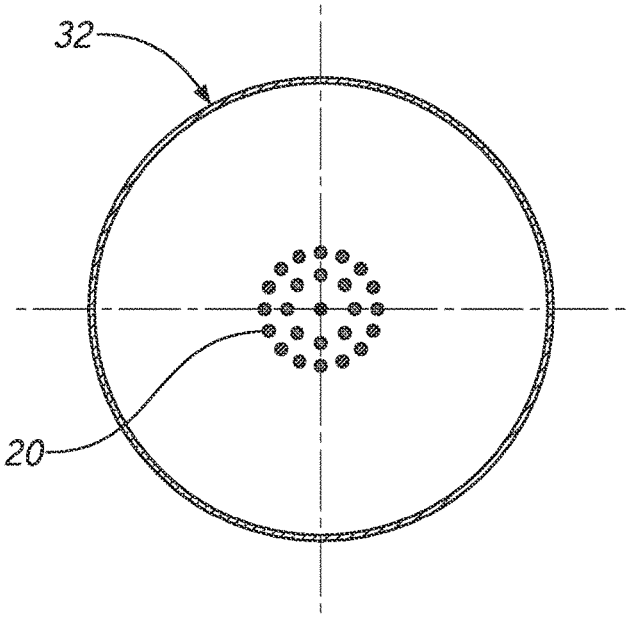
FIG. 23 is a cross-sectional view of the seismic isolator of FIG. 20, taken along line 23-23 in FIG. 22.
Figure 24:
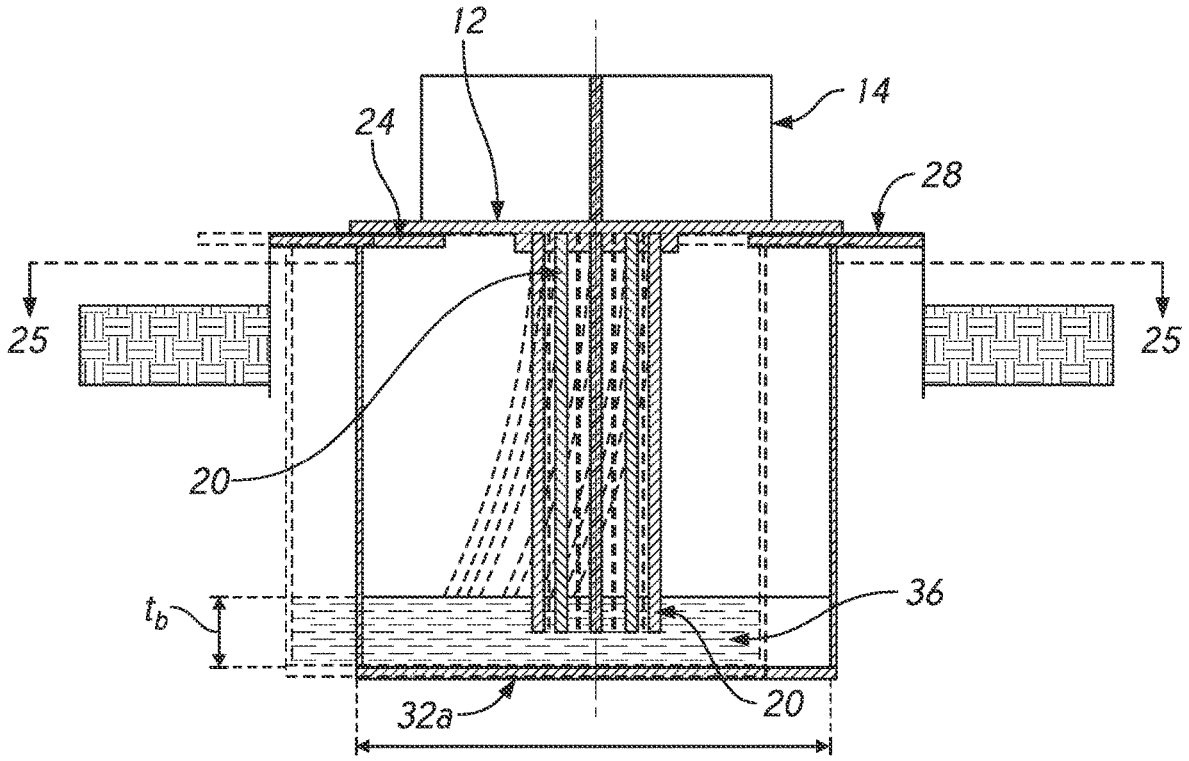
FIG. 24 is a cross-sectional schematic illustration of an embodiment of a sliding seismic isolator attached to a building support.
Figure 25:
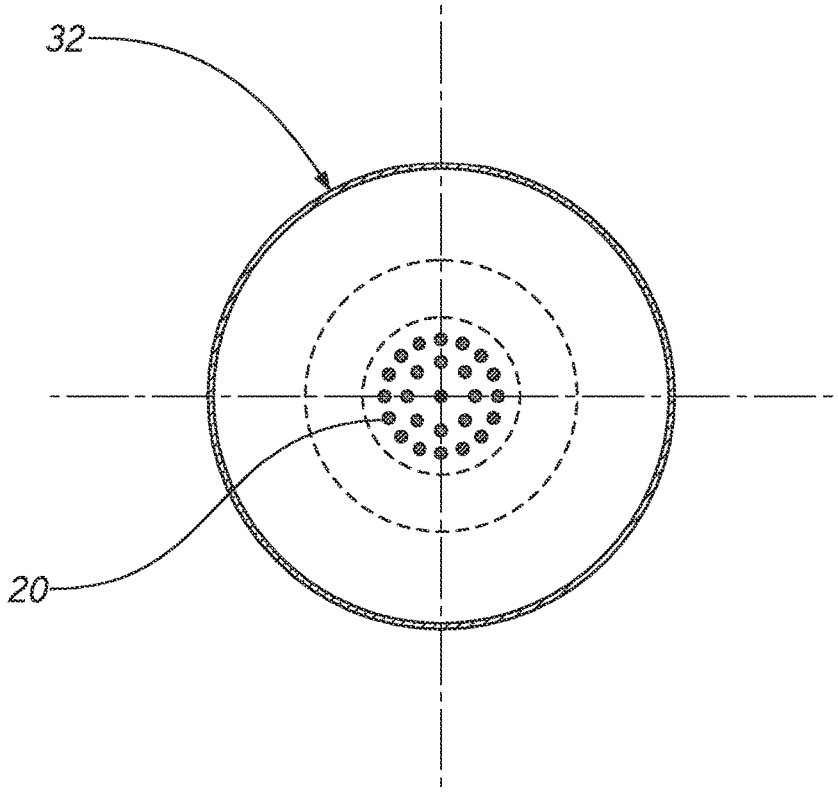
FIG. 25 is a cross-sectional view of the seismic isolator of FIG. 22, taken along line 25-25 in FIG. 24.

With reference to FIGS. 22-25, in some embodiments, there can be a void or space between the elongate element(s) 20 and the lower support element 32 and/or the base plate 32*a* of the seismic isolator 10. For example, the seismic isolator 10 may not include a biasing element 36 disposed to the lateral sides of the elongate element(s) 20, between the elongate element(s) 20 and the lateral sides of the lower support element 32. In some embodiments, the seismic isolator 10 can include a biasing element 36 disposed towards and/or limited to the base of the seismic isolator 10. As illustrated in FIG. 22, the biasing element 36 can have a thickness $t_b$. In the illustrated arrangement, an engagement of the biasing element 36 with the elongate element(s) 20 is limited to no more than a bottom third, no more than a bottom fifth, or no more than a bottom eighth or tenth of the elongate element(s) 20. The biasing element 36 can be a single component or multiple components (e.g., a stack of components). The biasing element 36 can comprise silicone, rubber, a liquid, and/or any other suitable material. The biasing element 36 can be connected or fixed to lateral sides and/or a bottom portion of the lower support element 32 and/or to a base plate 32*a* (e.g., using glue, vulcanization, etc.). The elongate element(s) 20 can extend into at least a portion of the biasing element 36. For example, as illustrated in FIG. 22, the length of the portion of the elongate element(s) 20 that extends into the biasing element 36 can be about half of the thickness $t_b$ of the biasing element 36. There can be a gap between the ends of the elongate element(s) 20 and the bottom of the lower support element 32 and/or the base plate 32*a*. The gap can include a portion of the biasing element 36. In some embodiments, the lower ends of the elongate element(s) 20 can be attached to the biasing element 36 (e.g., using glue, etc.). As illustrated in FIG. 24, this arrangement can require bending of the elongate element(s) 20 in the event of an earthquake, which can facilitate additional resistance to or damping of seismic forces. In some embodiments, a re-centering mechanism can be included in the seismic isolator 10.

With reference to FIGS. 26-34, in some embodiments, damping structures 40 can replace and/or supplement perforations 37 in the biasing element 36. In some embodiments, the seismic isolator 10 includes more than one damping structure 40. For example, the seismic isolator 10 can include 2-50 damping structures 40. In some embodiments, the damping structures 40 can have circular cross-sections. In some embodiments, the damping structures 40 can be hollow. For example, the damping structures 40 can be cylindrical tubes.

The damping structure 40 can be deformable. In some embodiments, the damping structure 40 can include a deformable periphery. In some embodiments, the damping structure 40 can include a rubber exterior. In some embodiments, the damping structure 40 can be a closed structure. For example, the damping structure 40 can have closed ends. In some embodiments, the damping structure 40 can be at least partially filled with a substance. In some embodiments, the entirety of the inside of the damping structure 40 is filled with a substance 45. For example, the damping structure 40 can be filled with a liquid, gas, and/or any other suitable substance (e.g., silicone) 45. This can create additional resistance to deformation of the damping structure 40 and can enable further damping of seismic forces.

Figure 26:
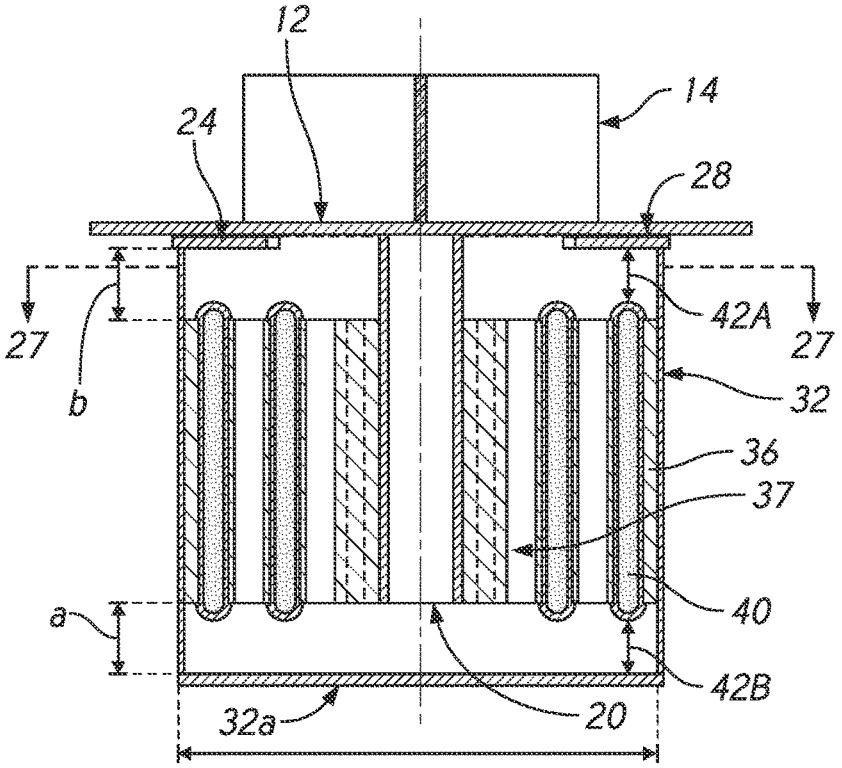
FIG. 26 is a cross-sectional schematic illustration of an embodiment of a sliding seismic isolator attached to a building support.
Figure 27:
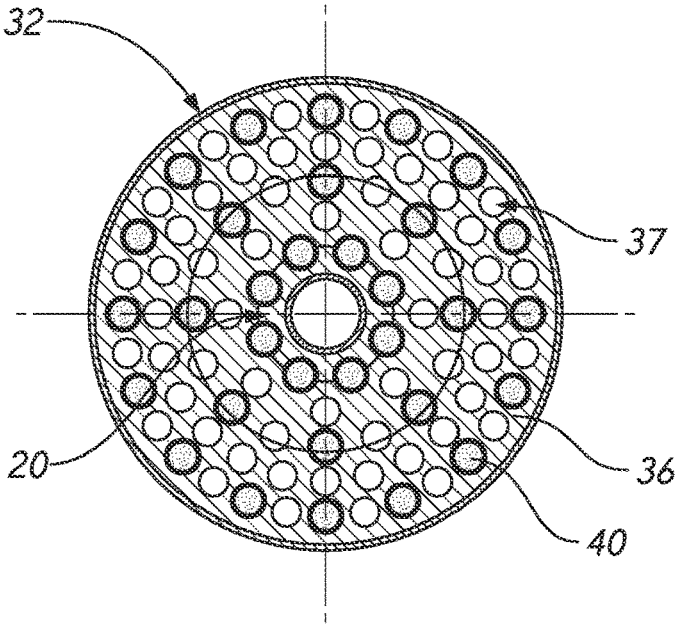
FIG. 27 is a cross-sectional view of the seismic isolator of FIG. 26, taken along line 27-27 in FIG. 26.
Figure 28:
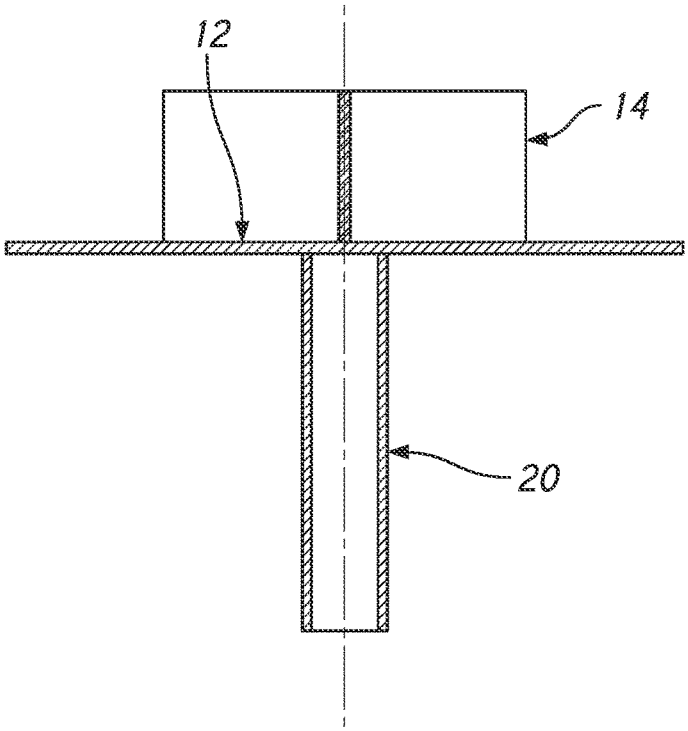
FIG. 28 is a front elevational view of the building support and a portion of the seismic isolator of FIG. 26.
Figure 29:
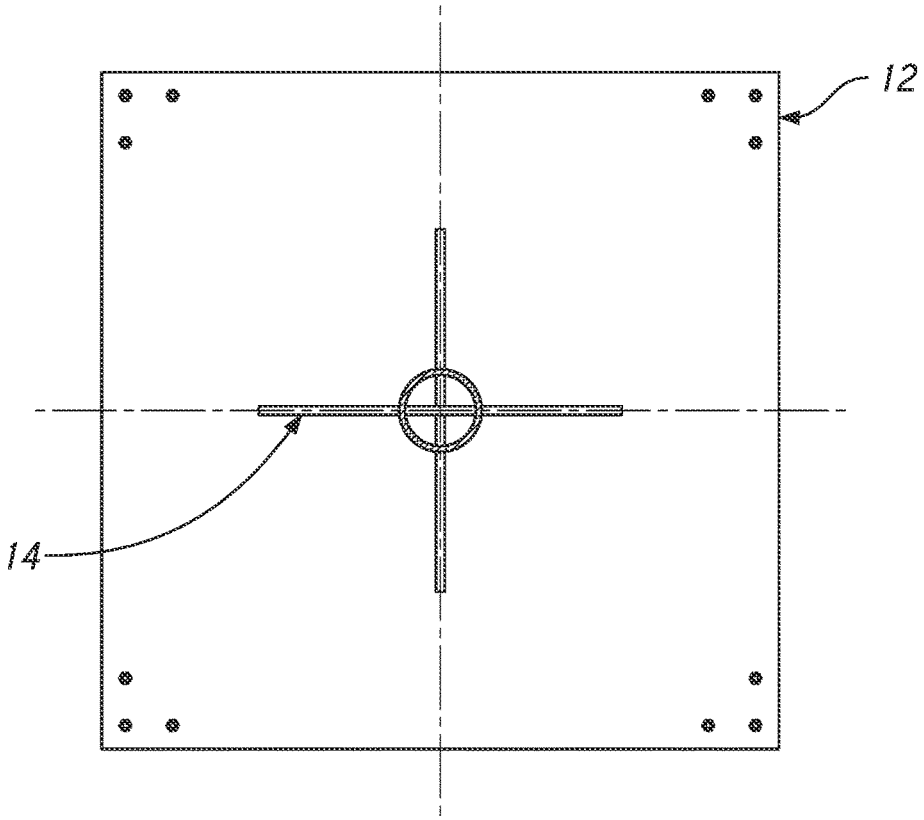
FIG. 29 is a top plan view of the building support and portion shown in FIG. 28.
Figure 30:
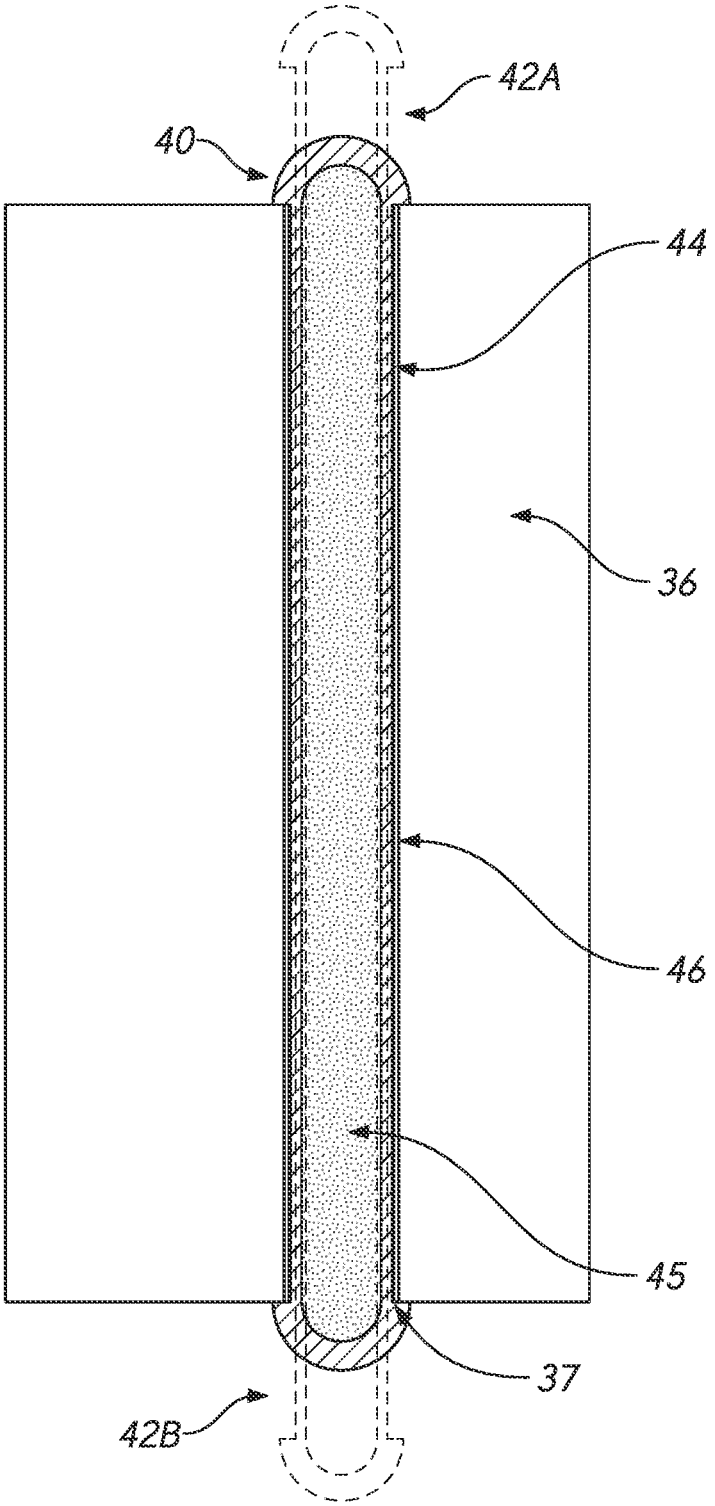
FIG. 30 is a detailed view of the damping structure of the seismic isolator of FIG. 26.
Figure 31:
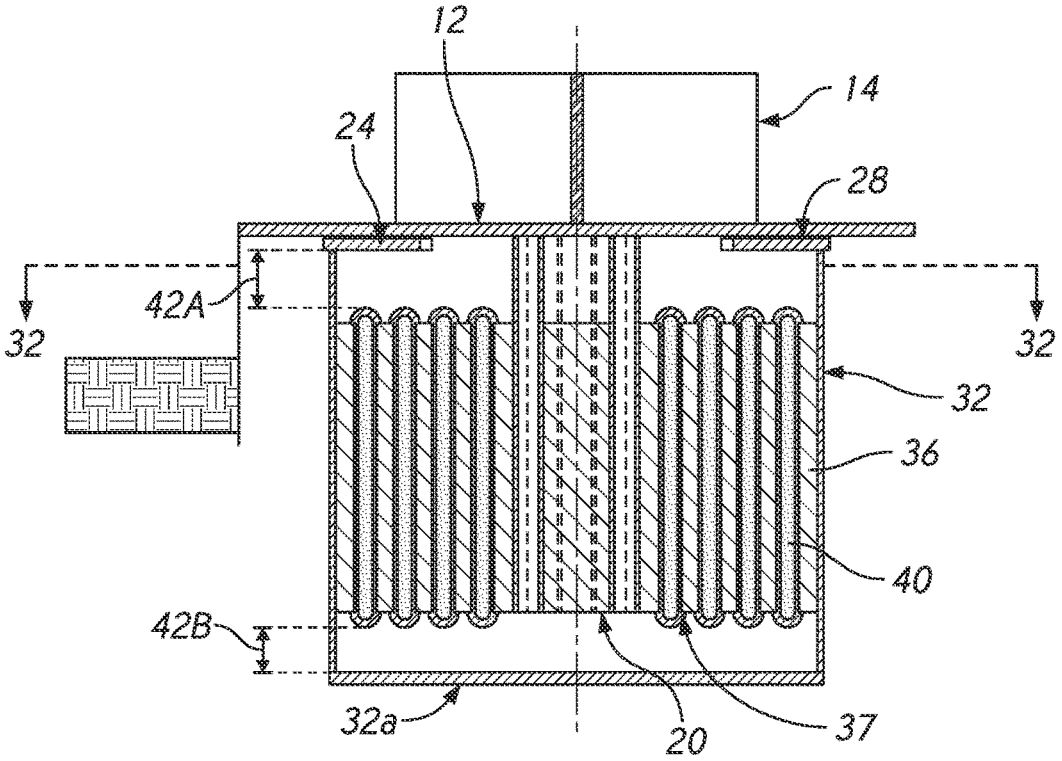
FIG. 31 is a cross-sectional schematic illustration of an embodiment of a sliding seismic isolator attached to a building support.
Figure 32:
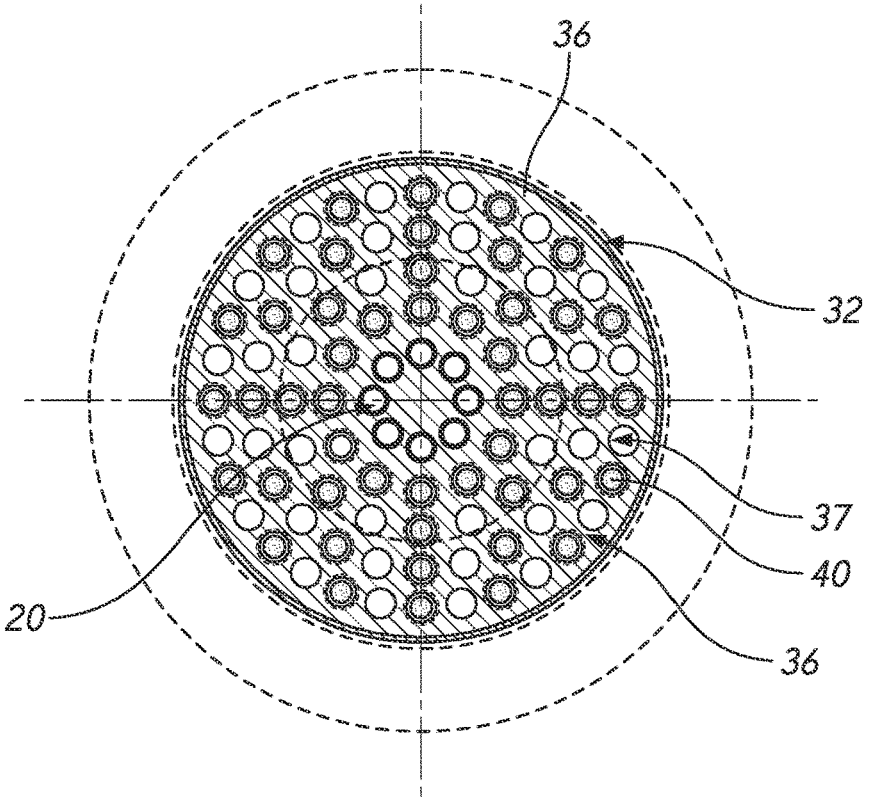
FIG. 32 is a cross-sectional view of the seismic isolator of FIG. 31, taken along line 32-32 in FIG. 31.
Figure 33:
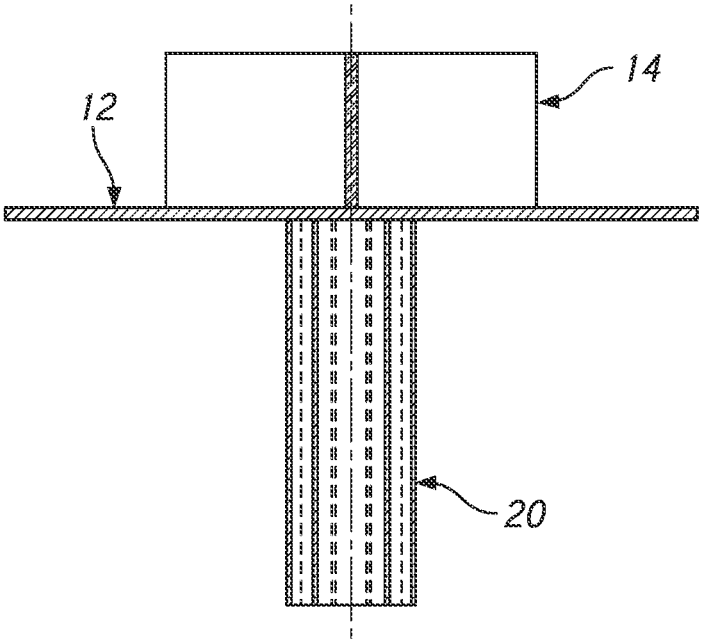
FIG. 33 is a front elevational view of the building support and a portion of the seismic isolator of FIG. 31.
Figure 34:
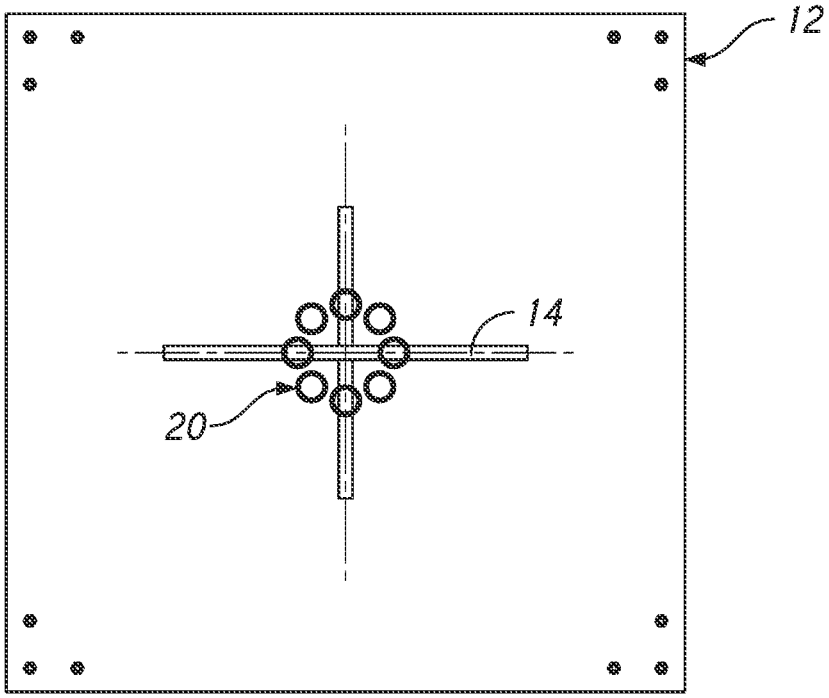
FIG. 34 is top plan view of the building support and portion shown in FIG. 33.

In some embodiments, as illustrated in FIG. 26, there is a gap 42A between a first end of the damping structure 40 and the first plate 12 and/or second plate 24. In some embodiments, there is a gap 42B between a second end of the damping structure 40 and the base of the seismic isolator 10. In some embodiments, there is a gap "a" between the bottom of the elongate element(s) 20 and/or the bottom of the biasing element 36 and the bottom of the lower support element 32. In some embodiments, there is a gap "b" between the top of the biasing element 36 and the first plate 12 and/or second plate 24. The gaps "a", "b" can be larger than the gaps 42B, 42A, respectively.

In some embodiments, the damping structure 40 is disposed within voids or perforations 37 in the biasing element 36. In some embodiments, there is a gap or a space 44 between the damping structure 40 and the perforations 37. However, the damping structure 40 could also be tightly received within the biasing element 36. In some embodiments, the space 44 between the damping structure 40 and the perforations 37 decreases when seismic forces are present. In some embodiments, seismic forces can cause the perforations 37 to compress, decrease in size, and/or move to a closed position. When subjected to seismic forces (e.g., radial pressure) during an earthquake, the damping structure 40 can expand longitudinally. For example, the damping structure 40 can expand in an upward longitudinal direction, in a downward longitudinal direction, or in both directions. The damping structure 40 can increase in length and/or decrease in diameter when compressed. In some embodiments, the damping structure 40 can expand into the gap or gaps 42A, 42B above and/or below each end of the damping structure 40. In some embodiments, the damping structure 40 and/or perforations 37 can return back toward or to an original resting position after the event of an earthquake.

In some embodiments, the damping structure 40 can include a layer 46 configured to reduce the amount of friction generated by the damping structure 40 during its longitudinal expansion. In some embodiments, the damping structure 40 can include a layer 46 disposed along a portion of the periphery of the damping structure 40. In some embodiments, the damping structure 40 can include a layer 46 disposed along the entire periphery of the damping structure 40. For example, the damping structure 40 can have a PTFE, or other suitable material, liner.

More than one seismic isolator 10 can be used for a given structure. For example, at least 2-10 or 2-20 seismic isolators 10 can be used together. The number of seismic isolators 10 can depend on the size of the structure, such as the size of a building or bridge. When multiple seismic isolators 10 are used together, the designs of some of the isolators 10 may differ. For example, the use of a plurality of isolators 10, wherein some of the isolator 10 designs differ, can assist in re-centering of the seismic isolators 10. Some of the isolators 10 can be primarily or solely used for shock absorption, with little or no re-centering capability, and some of the isolators 10 can be used for centering the plurality of isolators 10. The re-centering isolators 10 can also provide shock absorption. A combination of centering and non-centering isolators 10 can be used.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those skilled in the art based upon this disclosure. It is also contemplated that various combinations or sub-combinations of the specific features and aspects of the embodiments can be made and still fall within the scope of the inventions.

It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A sliding seismic isolator, comprising:

a first plate configured to be attached to a building support;

at least one elongate element extending from the first plate;

a second plate;

a low-friction layer positioned between the first and second plates and configured to allow the first and second plates to move relative one another along a horizontal plane;

a lower support member attached to the second plate;

a biasing element positioned within the lower support member, the biasing element comprising at least one void; and at least one damping structure disposed within the at least one void, the damping structure having a housing comprising a first closed end spaced from the first plate and a second closed end spaced from a base of the seismic isolator, the housing of the damping structure containing a deformable substance and being configured to expand longitudinally when compressed.

2. The isolator of claim 1, wherein the at least one damping structure comprises a plurality of damping structures.

3. The isolator of claim 1, further comprising a gap between an outer edge of the at least one damping structure and an outer edge of the at least one void.

4. The isolator of claim 1, wherein the at least one damping structure is a cylindrical tube filled with gas, liquid, silicone, or a combination thereof.

5. The isolator of claim 1, wherein the damping structure is at least partially filled with the deformable substance.

6. The isolator of claim 1, wherein the damping structure is filled entirely with the deformable substance.

7. The isolator of claim 1, wherein the deformable substance is silicone, liquid, gas, or a combination thereof.

8. The isolator of claim 1, further comprising a Polytetrafluoroethylene layer disposed around a periphery of the at least one damping structure.

9. The isolator of claim 1, wherein the at least one elongate element comprises a plurality of elongate elements.

10. The isolator of claim 1, wherein the biasing element is disposed towards the base of the seismic isolator.

11. The isolator of claim 10, wherein the biasing element is disposed adjacent to no more than a bottom third of the at least one elongate element.

12. The isolator of claim 1, wherein the biasing element comprises a stack of components.

13. The isolator of claim 1, further comprising a gap between a lower end of the at least one elongate element and the base of the isolator, at least a portion of the biasing element being disposed in the gap.

14. The isolator of claim 13, wherein the lower end of the at least one elongate element is attached to the biasing element.

15. A system comprising:

a plurality of isolators configured to be attached to a building support;

wherein at least one of the isolators is the isolator of claim 1; and wherein at least another one of the isolators is configured to provide a lower re-centering force than the isolator of claim 1.

16. The system of claim 15, wherein at least one of the isolators comprises a plurality of elongate elements.

17. The system of claim 15, wherein at least one of the isolators is configured to provide further reduction of seismic forces.

18. A method of supporting a structure for seismic isolation and re-centering, comprising:

supporting the structure with one or more of a first type of seismic isolator, wherein the first type of seismic isolator is the seismic isolator of claim 1; and supporting the structure with one or more of a second type of seismic isolator having a re-centering force that is lower than the first type of seismic isolator.

19. The method of claim 18, wherein the first type of seismic isolator is configured to provide more shock absorption than the second type of seismic isolator.

20. The method of claim 18, further comprising re-centering one or more of the first type of seismic isolator using one or more of the second type of seismic isolator.

* * * * *